United States Patent [19]

Turner

[11] 4,428,119

[45] Jan. 31, 1984

[54] DE-ENDING SHEARS

[76] Inventor: Willie L. Turner, No. 95190, Mecklenburg Correctional Center P.O. Box 500, Boydton, Va. 23917

[21] Appl. No.: 305,604

[22] Filed: Sep. 23, 1981

[51] Int. Cl.[3] ..... B26B 19/02

[52] U.S. Cl. ..... 30/212

[58] Field of Search ..... 30/30, 113, 145, 197, 30/211, 212–214, 226, 233.5, 241

[56] References Cited

U.S. PATENT DOCUMENTS

| | | | |
|---|---|---|---|
| 2,001,206 | 5/1935 | Matthes | 30/195 |
| 2,253,786 | 8/1941 | Hollander | 30/214 |
| 2,741,842 | 4/1956 | Shapin | 30/212 |
| 3,391,459 | 7/1968 | Rollo | 30/195 |
| 3,711,948 | 1/1973 | Ford et al. | 30/212 |

*Primary Examiner*—James M. Meister
*Assistant Examiner*—Douglas D. Watts
*Attorney, Agent, or Firm*—Cushman, Darby and Cushman

[57] ABSTRACT

A pair of manually operated de-ending shears for removing split ends. The shears float like shears but cut like clippers. The device includes a moving blade slidably mounted to a still blade and handle wherein a moving handle is provided for moving the moving blade through a cutting stroke. A spring pocketed by the blades provides the means for a reverse clipping stroke.

2 Claims, 11 Drawing Figures

DE-ENDING SHEARS

The present invention relates to an improved haircutting device. More particularly, the present invention provides a pair of de-ending shears.

The purpose of this device is to save much money, time, and energy because it is capable of floating like shears, but cutting like clippers. The present invention essentially overcomes the disadvantages of the conventional devices. De-ending shears will put an end to the waste of thousands of strokes to knock off a few split ends or to give a "meant to be quick" taper, which resulted in losing most of the profits in energy bills.

SUMMARY OF THE INVENTION

The haircutting device of the present invention are de-ending shears developed to simplify and make more efficient, for instance, the removal of split ends. The present inventive de-ending shears are also shaped in such a manner so that if they are dropped the cutting teeth will not be damaged on a flat surface. The present inventive de-ending shears are operated by hand, the same as opening and closing a normal set of hand shears, except for the blades which cut by a forward and back motion like clippers instead of by swinging backwards and forwards as a normal set of shears.

Reference is now made to the drawings and the following detailed description.

DESCRIPTION OF THE INVENTION AND DRAWINGS

Figure 8:
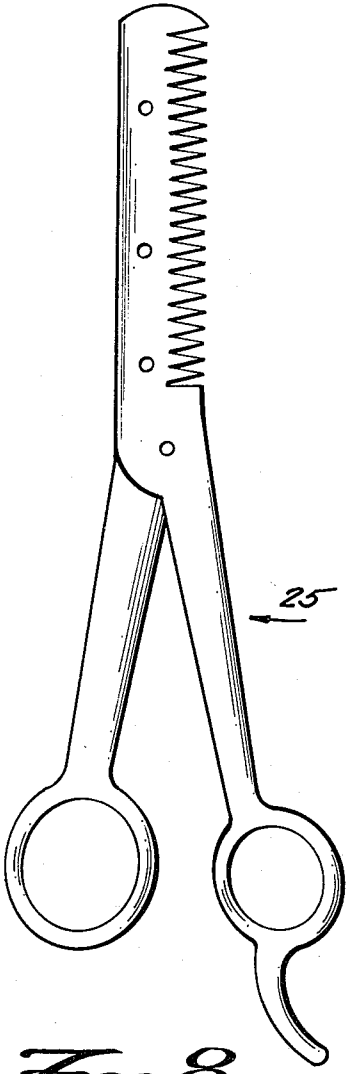

In FIG. 8, reference numeral 25 designates a plane view of the reversed side of the de-ending shears 1.

Figure 9:
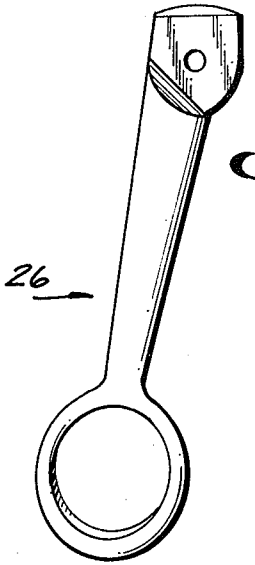

In FIG. 9, reference numeral 26 designates a reversed view of the moving handle.

Figure 10:
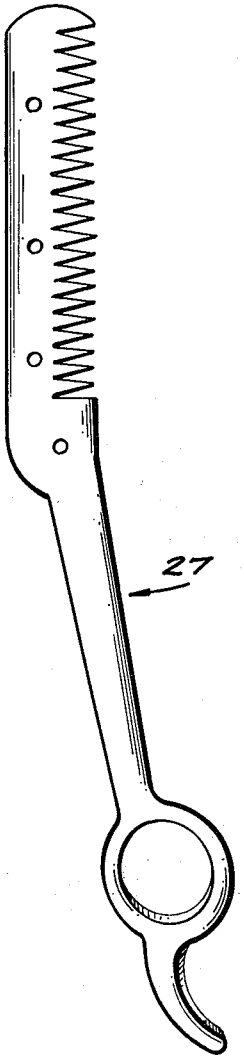

In FIG. 10, reference numeral 27 designates a reversed view of the moving handle.

Figure 11:
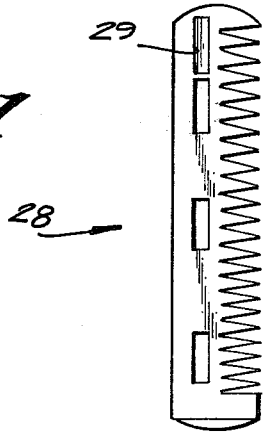

In FIG. 11, reference numeral 28 designates a reversed view of the moving blade.

Figures 1, 2, 3, 4, 5, 6, 7:
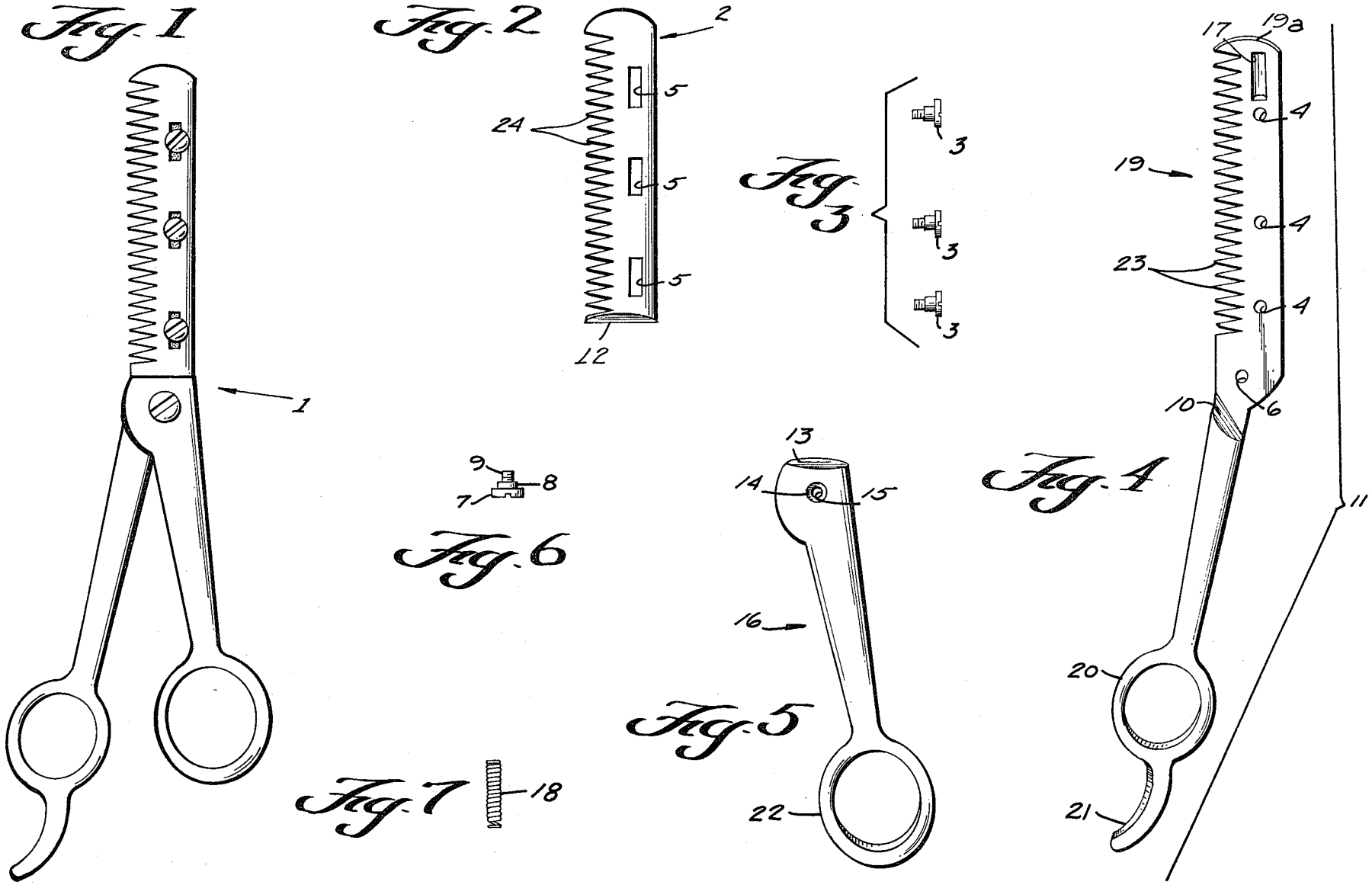
FIG. 1 illustrates in a plane side view the approximate size and design of the de-ending shears.
FIG. 2 illustrates in a side view of the moving blade of the de-ending shears of FIG. 1.
FIG. 3 illustrates the three screws employed to fix the moving blade to the still blade.
FIG. 4 illustrates the still blade and handle.
FIG. 5 illustrates the moving handle of the de-ending shears.
FIG. 6 illustrates a screw employed to pivotally mount the moving handle to the still blade and handle.
FIG. 7 illustrates a spring to be pocketed by a groove in the moving blade and in the still blade.

FIGS. 2 through 7 illustrate the main components of the apparatus as shown in FIG. 1 and are presented in order to describe the parts thereof separately and according to their places and purposes. In FIG. 2, reference numeral 2 is the moving blade. The approximate shape and thickness of the end view of the moving blade 2 is shown by reference numeral 12. In FIG. 3, screws 3 allow the moving blade 2 to be attached to the still blade 19 in FIG. 4.

The approximate size and shape of the elongated holes 5, i.e. slots, in the moving blade 2 are shown in FIG. 2. Holes 5 are designed so that moving blade 2 is capable of moving in a back and forward motion parallel to the still blade 19 while it is fixed in place to the still blade 19 with screws 3. Socket holes 4 in still blade 19 are for screws 3.

In FIG. 4, a screw socket 6 is shown. Screw socket 6 is where the moving handle 16 of FIG. 5 pivotable attaches to the still blade 19 by means of the screw 7. The approximate size and shape of the screw 7 is shown in FIG. 6.

As shown in FIG. 5, moving blade 16 has a groove 14 placed around the periphery of hole 15 so that the cap of the screw 7 will not protrude from the surface of the moving handle 16 when the de-ending shears are in a functionable state as illustrated in FIG. 1. In FIG. 5, an end view 13 to the moving handle 16 shows approximately the shape and thickness of said handle. Moving handle 16 has a thumb grip 22.

In FIG. 6, the smooth part of screw shaft 8 is designed so when the parts of the de-ending shears are assembled in a working manner, the tension of the screw 7 will apply to the still blade 19, but not to the moving blade 12. (FIG. 5 also shows hole 15 through which screw 7 fits such that this is achieved. FIG. 5 also shows the approximate size of hole 15.) The threaded part of the shaft to screw 7 is shown by reference numeral 9. The threaded part 9 is threaded into screw socket 6 of the still blade 19.

In FIG. 4, the reference numeral 10 designates the area where the still blade handle is tapered to blend in with the still blade 18.

In FIG. 4, the overall combination of the still handle and still blade are shown by reference numeral 11.

In FIG. 4, still blade 19 has one groove 17. In FIG. 11, groove 29 is provided for spring 18. Spring 18 is illustrated in FIG. 7. Spring 18 will be pocketed by grooves 29 and 17 when the de-ending shears are in operating order. That is, one end of the screw will be attached at one end to one end of groove 17. The other end of screw 18 will be attached at the opposite end of the pocket to the end of the groove 29. In operation, spring 18 reverses the approximately $\frac{1}{8}$ of an inch forward movement of the moving blade 2, which takes place when the moving handle 16 is pressed toward the still handle and blade combination 11.

In further reference to FIG 4, the approximate shape and thickness of still blade 19 is shown by 19(*a*) and further features of the still blade and handle combination 11 are shown as including finger grip 20 and a finger rest 21.

The approximate size and length of the teeth 23 to the still blade 19 is shown in FIG. 4. FIG. 2 illustrates cutting teeth 23 on moving blade 2.

What is claimed is:

1. A hand operable hair cutting device comprising:

(a) an integral member having a handle portion joined to a cutting blade portion, said cutting blade portion having a plurality of cutting teeth along one side thereof and a first elongated groove in a first surface thereof, said handle portion having a finger grip, said elongated groove being disposed at the end of said integral member opposite said handle portion;

(b) a slidably moveable member mounted alongside said cutting blade portion, said moveable member having (i) a plurality of cutting teeth such that said teeth on said moveable member and on said cutting blade portion cooperate and are adapted for cutting hair received between said teeth, (ii) a second elongated groove in the surface of said moveable member which surface is opposite to and facing said first surface such that said first and second elongated grooves are in registry, and (iii) longitudinally elongated slots extending through said moveable member;

(c) means for slidably mounting said moveable member to said cutting blade portion, said mounting means including a plurality of posts corresponding in number to the number of elongated slots in said moveable member, such that a first end of each said post joins said cutting blade portion, extends therefrom through a said elongated slot, and the second end of each said post protrudes from a said elongated slot and holds said moveable member against said cutting blade portion while permitting the sliding of said moveable member about said post through a length equivalent to a said elongated slot;

(d) a spring longitudinally pocketed by said elongated grooves when said moveable member and said integral member are slidably mounted together, said pocketed spring being disposed between said mounting means and the end of said integral member opposite said handle portion; and (e) a moveable handle having the first end thereof pivotably attached to said integral member where said cutting blade portion and said handle portion join together and the second end thereof forming a thumb grip, said moveable handle being in engagement with said moveable blade such that a hair clipping stroke is initiated by depressing said moveable handle towards said integral member and a reverse clipping stroke is effected upon the release of said moveable handle such that said moveable blade is reversed by said spring.

2. A hand operable device as in claim 1, wherein said mounting means comprises three screws and said moveable blade has three elongated slots therein.

* * * * *